US009616550B2

(12) United States Patent
Chou et al.

(10) Patent No.: US 9,616,550 B2
(45) Date of Patent: Apr. 11, 2017

(54) GRINDING TOOL AND METHOD OF MANUFACTURING THE SAME

(71) Applicant: Kinik Company, Taipei (TW)

(72) Inventors: Jui-Lin Chou, New Taipei (TW); I-Tsao Liao, New Taipei (TW); Chia-Feng Chiu, New Taipei (TW)

(73) Assignee: Kinik Company (TW)

( * ) Notice: Subject to any disclaimer, the term of this patent is extended or adjusted under 35 U.S.C. 154(b) by 0 days.

(21) Appl. No.: 14/887,347

(22) Filed: Oct. 20, 2015

(65) Prior Publication Data

US 2016/0114465 A1 Apr. 28, 2016

(30) Foreign Application Priority Data

Oct. 23, 2014 (TW) ..... 103136676 A

(51) Int. Cl.
*B24D 11/00* (2006.01)
*B24D 18/00* (2006.01)

(52) U.S. Cl.
CPC ..... *B24D 11/00* (2013.01); *B24D 18/0072* (2013.01)

(58) Field of Classification Search
CPC ..... B24D 11/00; B24D 18/0072
USPC .. 451/548, 541, 526, 527, 533, 534, 539, 58
See application file for complete search history.

(56) References Cited

U.S. PATENT DOCUMENTS 2,138,882 A * 12/1938 Robie ..... B24D 11/00 451/536
5,454,343 A * 10/1995 Eun ..... C01B 31/06 117/1
6,123,612 A * 9/2000 Goers ..... B24B 53/017 451/540
8,777,699 B2 * 7/2014 Sung ..... H01L 23/3732 451/443
8,905,823 B2 * 12/2014 Wu ..... B24B 53/017 451/443
2010/0022174 A1 * 1/2010 Chou ..... B24D 3/002 451/548
2010/0248595 A1 * 9/2010 Dinh-Ngoc ..... B24B 37/04 451/56

(Continued)

FOREIGN PATENT DOCUMENTS

TW 201350267 A 12/2013

OTHER PUBLICATIONS

Office Action dated May 10, 2016 for co-pending Taiwan Patent Application No. 103136676.

*Primary Examiner* — George Nguyen
(74) *Attorney, Agent, or Firm* — Baker & McKenzie LLP; David I. Roche

(57) ABSTRACT

A grinding tool includes a rigid support body and a carrier substrate. The carrier substrate is attached to the support body, and is supported by the support body. Two opposing surfaces of the carrier substrate respectively define a working surface and a non-working surface. A plurality of first abrasive particles are affixed on the working surface, and a plurality of second abrasive particles are affixed on the non-working surface. The first abrasive particles have a first average size, and the second abrasive particles have a second average size smaller than the first average size. The carrier substrate is attached to the support body at the non-working surface. Moreover, a method of manufacturing the grinding tool is described herein.

34 Claims, 3 Drawing Sheets

(56) References Cited

U.S. PATENT DOCUMENTS

| | | | | |
|---|---|---|---|---|
| 2011/0031032 | A1* | 2/2011 | Mourik | C22C 26/00 175/428 |
| 2011/0031033 | A1* | 2/2011 | Mourik | C22C 26/00 175/428 |
| 2012/0302146 | A1* | 11/2012 | Sung | B24B 53/017 451/443 |
| 2014/0231151 | A1* | 8/2014 | Matthias | B24D 18/0009 175/432 |

* cited by examiner

GRINDING TOOL AND METHOD OF MANUFACTURING THE SAME

CROSS-REFERENCE TO RELATED APPLICATION(S)

This application claims priority to Taiwan Patent Application No. 103136676 filed on Oct. 23, 2014, which is incorporated herein by reference.

BACKGROUND

1. Field of the Invention

The present invention generally relates to grinding tools, and more particularly to grinding tools used in wafer polishing techniques.

2. Description of the Related Art

Grinding and/or polishing techniques are generally applied to create a desirable surface roughness or planarity of a rigid part, such as metal, ceramic or glass parts, or semiconductor wafers. To this purpose, the grinding and/or polishing techniques use tools having abrasive elements that can wear the rigid surface.

During the fabrication of a grinding tool, the abrasive elements are conventionally affixed to a substrate of the grinding tool by sintering or brazing. This high-temperature process may cause thermal deformation of the substrate, which may result in a non-uniform height of the abrasive elements attached thereon. In order to reduce thermal deformation, the material of the substrate needs to be properly selected, which may add constraints to the fabrication process.

According to another approach, an adhering agent may be used to bind the abrasive elements to the working surface of the substrate. However, owing to the melt flow of the adhering agent and the contraction mismatch between the adhering agent and the substrate, it may be difficult to control the height of the abrasive elements adhered to the substrate.

In a conventional grinding tool, the substrate with the abrasive elements affixed thereon is further attached to a support member by heat press. As the substrate may be subject to warping during thermal stress, some approach also proposes to provide an additional layer of abrasive elements affixed on the other side of the substrate opposite to the working surface. The distribution of two layers of abrasive elements on two opposite sides of the substrate can help to keep the substrate planar during thermal stress. However, it has been observed that in practice a totally flat substrate may not be able to tightly adhere to the support member, which may eventually result in a grinding tool that has a non-uniform height of the abrasive elements on the working surface.

Therefore, there is a need for an improved design that can fabricate a grinding tool having abrasive elements of a uniform height on the working surface, and can address at least the foregoing issues.

SUMMARY

The present application describes a grinding tool having a uniform height of abrasive particles on the working surface, and a method of fabricating the grinding tool. In one embodiment, the grinding tool includes a rigid support body, and a carrier substrate affixed to the support body and having a working surface and a non-working surface on two opposite sides. The working surface has a plurality of first abrasive particles affixed thereon, the non-working surface has a plurality of second abrasive particles affixed thereon, and the non-working surface is affixed to the support body. The first abrasive particles has a first average particle diameter, and the second abrasive particles has a second average particle diameter smaller than the first average particle diameter.

In another embodiment, the grinding tool includes a rigid support body, and a carrier substrate affixed to the support body and having a working surface and a non-working surface on two opposite sides. A plurality of first abrasive particles are affixed on the working surface via a first bonding layer, and a plurality of second abrasive particles are affixed on the non-working surface via a second bonding layer, the second bonding layer being smaller than the first bonding layer in thickness, and the non-working surface being affixed to the support body.

The present application further describes a method of fabricating a grinding tool. The method includes providing a carrier substrate that has a working surface and a non-working surface respectively defined on two opposite sides; affixing a plurality of first abrasive particles on the working surface, the first abrasive particles having a first average particle diameter, affixing a plurality of second abrasive particles on the non-working surface, the second abrasive particles having a second average particle diameter that differs from the first average particle diameter, the carrier substrate with the first and second abrasive particles affixed thereon having a warped profile that protrudes on the side of the working surface; and pressing the carrier substrate having the warped profile against a support body, and attaching the carrier substrate to the support body.

DETAILED DESCRIPTION OF THE EMBODIMENTS

Figure 1:
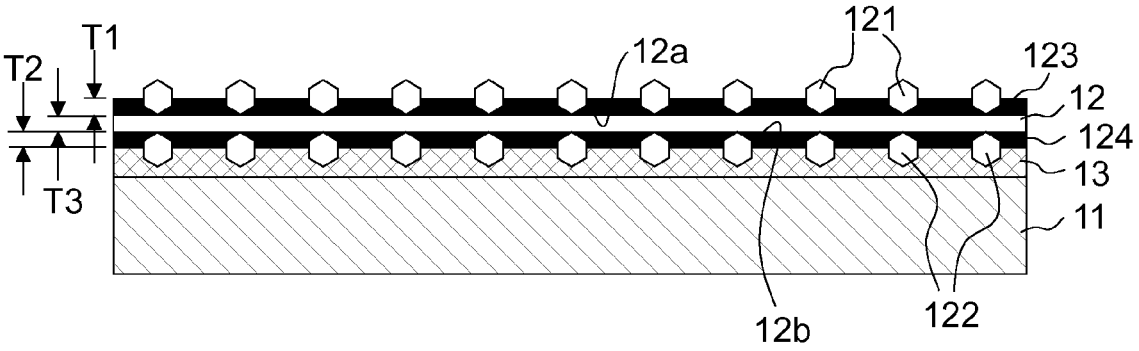
FIG. 1 is a schematic view illustrating an embodiment of a grinding tool.

FIG. 1 is a schematic view illustrating an embodiment of a grinding tool 1. In some examples of applications, the grinding tool 1 may be used in a chemical mechanical polishing process for conditioning a polisher pad. The grinding tool 1 includes a rigid support body 11 and a carrier substrate 12 affixed with each other, the support body 11 providing rigid support for the carrier substrate 12. The carrier substrate 12 has two opposite surfaces that respectively define a working surface 12*a* and a non-working surface 12*b*. A plurality of first abrasive particles 121 are dispersed on the working surface 12*a*, and a plurality of second abrasive particles 122 are dispersed on the non-working surface 12*b*. The first and second abrasive particles 121 and 122 are respectively affixed to the carrier substrate 12 via a first and a second bonding layer 123 and 124. The carrier substrate 12 is affixed with the support body 11 on the side of the non-working surface 12*b*. In one embodiment, the carrier substrate 12 can be made of a metallic material.

In some embodiments, techniques such as brazing, sintering or electroplating can be applied to affix the first and second abrasive particles 121 and 122 to the carrier substrate 12 via the first and second bonding layers 123 and 124. The first and second bonding layers 123 and 124 can be exemplary metallic or ceramic layers.

In certain embodiments, the first abrasive particles 121 have a first average particle diameter D1, and the second abrasive particles 122 have a second average particle diameter D2 smaller than D1. It will be understood that the "particle diameter" as used herein impose no limitation on the shape of the first and second abrasive particles 121 and 122 (e.g., it does not mean that the abrasive particles necessarily have to be circular in shape). Rather, a person of ordinary skill in the art will appreciate that the abrasive particles can have various shapes, and that the "particle diameter" of an abrasive particle refers to a measurable dimension of a shape approximating or representative of the size of the abrasive particle. For example, the particle diameter can be the diameter of a circle that has a same surface area as that of an image projection of an abrasive particle on a plane, or an aperture dimension of a mesh screen used to filter a particle size. Accordingly, a person of ordinary skill in the art would appreciate that the "particle diameter" refers to a dimension associated with a method of measuring the size of the abrasive particles, which does not limit the abrasive particles to any specific shape.

A difference between the average particle diameter D1 of the first abrasive particles 121 and the average particle diameter D2 of the second abrasive particles 122 also results in the average size of the first abrasive particles 121 being different from the average size of the second abrasive particles 122. Because the second average particle diameter D2 of the second abrasive particles 122 is smaller than the first average particle diameter D1 of the first abrasive particles 121 (i.e., the average size of the second abrasive particles 122 is smaller than the average size of the first abrasive particles 121), different tension forces can be applied on the two opposite sides of the carrier substrate 12 before it is attached to the support body 11. Accordingly, after the first and second abrasive particles 121 and 122 are respectively bonded to the carrier substrate 12 (e.g., by brazing, sintering or electroplating), the working and non-working surfaces 12*a* and 12*b* can be subject to differential tension that warps the carrier substrate 12, the working surface 12*a* where are bonded the first abrasive particles 121 forming a generally convex profile (better shown in FIG. 2C). Providing a curved carrier substrate 12 can facilitate its attachment to the support body 11 as further described hereinafter.

In at least one embodiment, the ratio of the second average particle diameter D2 to the first average particle diameter D1 can be between about 90% and 99.5%. The first and second average particle diameters D1 and D2 can be respectively between about 50 μm and about 300 μm. For example, the first average particle diameter D1 can be about 250 μm and the second average particle diameter D2 can be about 248 μm, or the first average particle diameter D1 can be about 205 μm and the second average particle diameter D2 can be about 200 μm.

In some embodiments, the first bonding layer 123 can have a first thickness T1, and the second bonding layer 124 can have a second thickness T2 smaller than the first thickness T1. This thickness difference between the two bonding layers 123 and 124 can result in differential tension applied between the two opposite sides of the carrier substrate 12, which can warp the carrier substrate 12 in the same direction described previously, i.e., having the working surface 12*a* forming a generally convex profile. In some embodiments, the second thickness T2 can be about 90% to 99.5% of the first thickness T1. For example, the first thickness T1 can be about 0.17 mm and the second thickness T2 can be about 0.167 mm.

In some variant embodiments, the formed carrier substrate 12 can have the second average particle diameter D2 of the second abrasive particles 122 smaller than the first average particle diameter D1 of the first abrasive particles 121, and the second thickness T2 of the second bonding layer 124 smaller than the first thickness T1 of the first bonding layer 123. This configuration can likewise generate differential tension between the two opposite sides of the carrier substrate 12, which warps the carrier substrate 12 and consequently causes the working surface 12*a* to form a generally convex profile.

Figure 2A:
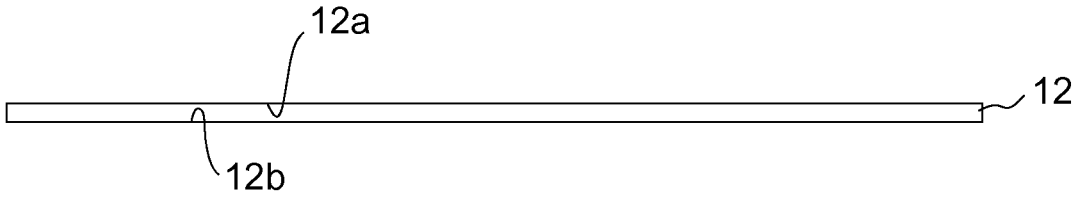
FIGS. 2A-2D are schematic views illustrating various stages in a process of fabricating a grinding tool.
Figure 2B:
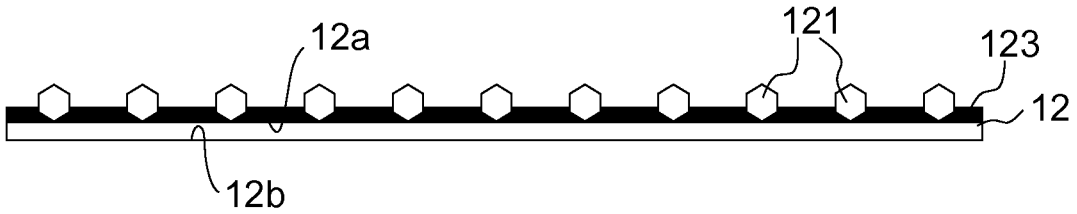
Figure 2C:
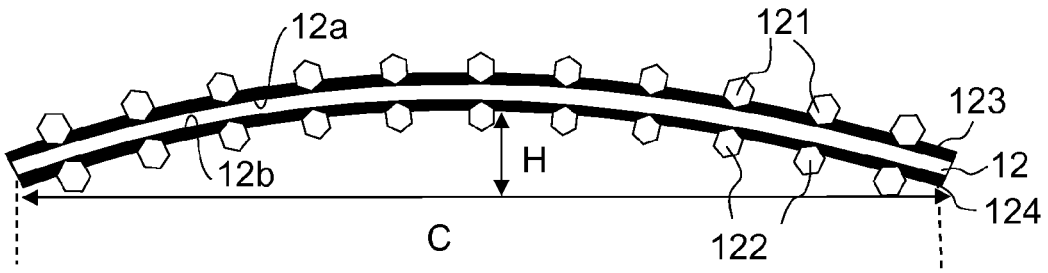

FIG. 2C schematically shows a cross-section of the warped carrier substrate 12 with the abrasive particles 121 and 122 attached thereon, before it is attached to the support body 11. The warped carrier substrate 12 can form an arc having two opposite endpoints connected with a chord C and a height H as the distance from the chord C to a center point on the arc (i.e., corresponding to a highest point on the arc). In one embodiment, the carrier substrate 12 can be warped such that the ratio of the height H to the chord C is about 0.5% to about 1%.

The first and second abrasive particles 121 and 122 can be made of any suitable materials having high hardness. Examples of suitable materials can include diamond, cubic boron nitride, aluminum oxide, and silicon carbide.

In some embodiments, the first abrasive particles 121 are distributed in a first distribution area on the working surface 12*a*, the second abrasive particles 122 are distributed in a second distribution area on the non-working surface 12*b*, and the first and second distribution areas can have substantially similar shapes and surface areas. For example, the first distribution area of the first abrasive particles 121 and the second distribution area of the second abrasive particles 122 can be concentric circles, chessboard, lozenge array, etc., which are similar in shape and surface area.

In some embodiments, the carrier substrate 12 can have a thickness T3 (i.e., without the two bonding layers 123 and 124 and the two layers of abrasive particles 121 and 122) between about 0.07 mm and about 2 mm. For example, the thickness T3 of the carrier substrate 12 can be about 0.2 mm.

In some embodiments, the carrier substrate 12 with the two layers of abrasive particles 121 and 122 attached thereon can be adhered to the support body 11 via an adhesion layer 13. The adhesion layer 13 can exemplary be epoxy or polymethylmethacrylate (PMMA).

In certain embodiments, the support body 11 alone can have a thickness between about 1 mm and about 20 mm. The support body 11 can exemplary be made of stainless steel or epoxy.

In conjunction with FIG. 1, FIGS. 2A-2D are schematic views illustrating exemplary intermediate stages in a process of fabricating the grinding tool 1. Referring to FIG. 2A, the carrier substrate 12 is first provided, two opposite sides of the carrier substrate 12 respectively forming the working surface 12*a* and the non-working surface 12*b*. The carrier substrate 12 can have a thickness T3 between about 0.07 mm and about 2 mm, e.g., about 0.2 mm. The carrier substrate 12 can be exemplary made of a metallic material.

Referring to FIG. 2B, the first abrasive particles 121 are bonded to the working surface 12*a* of the carrier substrate 12 via the first bonding layer 123. Exemplary techniques for bonding the first abrasive particles 121 to the working surface 12*a* of the carrier substrate 12 can include brazing, sintering, electroplating and the like. The first abrasive particles 121 can have a first average particle diameter D1, and can be made of suitable materials having high hardness such as diamond, cubic boron nitride, aluminum oxide, and silicon carbide.

Referring to FIG. 2C, the second abrasive particles 122 are bonded to the non-working surface 12*b* of the carrier substrate 12 via the first bonding layer 124. The second abrasive particles 122 can be made of suitable materials having high hardness such as diamond, cubic boron nitride, aluminum oxide, and silicon carbide. Exemplary techniques for bonding the second abrasive particles 122 to the non-working surface 12*b* of the carrier substrate 12 can include brazing, sintering, electroplating and the like. The second abrasive particles 122 attached to the non-working surface 12*b* can have a second average particle diameter D2 different from the first average particle diameter D1. In particular, the second average particle diameter D2 is smaller than the first average particle diameter D1.

As described previously, because the second abrasive particles 122 have an average size smaller than that of the first abrasive particles 121 (i.e., the second average particle diameter D2 smaller than the first average particle diameter D1), the two opposite sides of the carrier substrate 12 are subject to differential tension that warps the carrier substrate 12, the working surface 12*a* thereby forming a generally convex profile and the non-working surface 12*b* forming a generally concave profile. In some embodiments, the ratio of the second average particle diameter D2 to the first average particle diameter D1 can be between about 90% and 99.5%. The first and second average particle diameters D1 and D2 can be respectively between 50 μm and 300 μm. For example, the first average particle diameter D1 can be about 250 μm and the second average particle diameter D2 can be about 248 μm, or the first average particle diameter D1 can be about 205 μm and the second average particle diameter D2 can be about 200 μm.

Referring again to FIG. 2C, aside or in addition to providing abrasive particles 121 and 122 of different average particle diameters D1 and D2, some variant embodiments may also configure the first thickness T1 of the first bonding layer 123 greater than the second thickness T2 of the second bonding layer 124 to cause warping of the carrier substrate 12. In some embodiments, the second thickness T2 can be about 90% to 99.5% of the first thickness T1. For example, the first thickness T1 can be about 0.17 nun and the second thickness T2 can be about 0.167 mm. As described previously, the thickness difference between the two bonding layers 123 and 124 can cause warping of the carrier substrate 12, such that the working surface 12*a* has a generally convex profile while the non-working surface 12*b* has a generally concave profile.

Figure 2D:
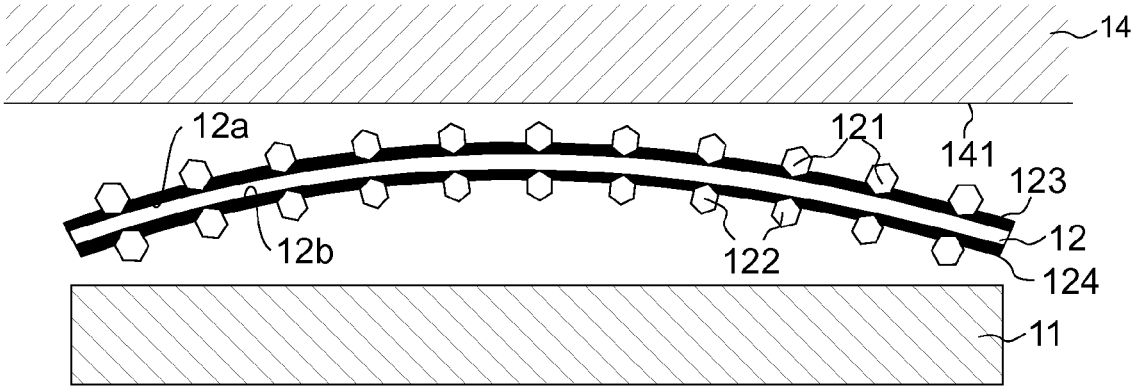

Next referring to FIG. 2D, the warped carrier substrate 12 with the abrasive particles 121 and 122 attached thereon is then bonded to the support body 11. To this purpose, the carrier substrate 12 can be placed so that the non-working surface 12*b* thereof faces the support body 11, while the working surface 12*a* faces a control surface 141 of a press tool 14. Heating is then applied (e.g., at a temperature between about 60 and 100 degrees Celsius) while the press tool 14 presses the carrier substrate 12 against the support body 11.

In certain embodiments, a cushion layer (not shown) may be interposed between the working surface 12*a* of the carrier substrate 12 and the control surface 141 of the press tool 14. The cushion layer can ensure that the pressure applied by the press tool 14 is uniformly transmitted onto the entire working surface 12*a* of the carrier substrate 12 while preventing damage of the first abrasive particles 121.

When the carrier substrate 12 is pressed against the support body 11 by the press tool 14, the carrier substrate 12 can elastically flatten and become substantially parallel to the plane of the control surface 141. As a result, the non-working surface 12*b* with the second abrasive particles 122 thereon can be uniformly bonded to the support body 11, and partial rising of the edges of the carrier substrate 12 can be prevented. This can ensure that the first abrasive particles 121 on the working surface 12*a* are at a substantially similar height, so that the entire working surface 12*a* can provide effective grinding action.

Realizations of the grinding tool and its manufacture process have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A grinding tool comprising:

a rigid support body; and a carrier substrate affixed to the support body and having a working surface and a non-working surface on two opposite sides, the working surface having a plurality of first abrasive particles affixed thereon, the non-working surface having a plurality of second abrasive particles affixed thereon, the first abrasive particles having a first average particle diameter, the second abrasive particles having a second average particle diameter smaller than the first average particle diameter, and the non-working surface being affixed to the support body.

2. The grinding tool according to claim 1, wherein a ratio of the second average particle diameter to the first average particle diameter is between about 90% and 99.5%.

3. The grinding tool according to claim 1, wherein the first and second average particle diameters are respectively between about 50 μm and about 300 μm.

4. The grinding tool according to claim 1, wherein the first and second abrasive particles are respectively affixed to the working surface and the non-working surface via a first and a second bonding layer, the first bonding layer having a first thickness, and the second bonding layer having a second thickness smaller than the first thickness.

5. The grinding tool according to claim 4, wherein the second thickness is about 90% to 99.5% of the first thickness.

6. The grinding tool according to claim 4, wherein any of the first and second bonding layers is a metallic or ceramic layer.

7. The grinding tool according to claim 1, wherein the carrier substrate is made of a metallic material.

8. The grinding tool according to claim 1, wherein the carrier substrate has a thickness between about 0.07 mm and about 2 mm.

9. The grinding tool according to claim 1, wherein the support body has a thickness between about 1 mm and about 20 mm.

10. The grinding tool according to claim 1, wherein the material of the first and second abrasive particles includes diamond, cubic boron nitride, aluminum oxide or silicon carbide.

11. The grinding tool according to claim 1, wherein the support body is made of stainless steel or epoxy.

12. The grinding tool according to claim 1, wherein the carrier substrate is affixed to the support body via an adhesion layer made of epoxy or polymethylmethacrylate (PMMA).

13. The grinding tool according to claim 1, wherein the first abrasive particles are distributed in a first distribution area on the working surface, the second abrasive particles are distributed in a second distribution area on the non-working surface, and the first and second distribution areas have substantially similar shapes and surface areas.

14. A grinding tool comprising:

a rigid support body; and a carrier substrate affixed to the support body and having a working surface and a non-working surface on two opposite sides, a plurality of first abrasive particles being affixed on the working surface via a first bonding layer, a plurality of second abrasive particles being affixed on the non-working surface via a second bonding layer, the second bonding layer being smaller than the first bonding layer in thickness, and the non-working surface being affixed to the support body.

15. The grinding tool according to claim 14, wherein the thickness of the second bonding layer is between about 90% and about 99.5% of the thickness of the first bonding layer.

16. The grinding tool according to claim 14, wherein any of the first and second bonding layers is a metallic or ceramic layer.

17. The grinding tool according to claim 14, wherein the carrier substrate is made of a metallic material.

18. The grinding tool according to claim 14, wherein the carrier substrate has a thickness between about 0.07 mm and about 2 mm.

19. The grinding tool according to claim 14, wherein the support body has a thickness between about 1 mm and about 20 mm.

20. The grinding tool according to claim 14, wherein the material of the first and second abrasive particles includes diamond, cubic boron nitride, aluminum oxide or silicon carbide.

21. The grinding tool according to claim 14, wherein the support body is made of stainless steel or epoxy.

22. The grinding tool according to claim 14, wherein the carrier substrate is affixed to the support body via an adhesion layer made of epoxy or polymethylmethacrylate (PMMA).

23. The grinding tool according to claim 14, wherein the first abrasive particles are distributed in a first distribution area on the working surface, the second abrasive particles are distributed in a second distribution area on the non-working surface, and the first and second distribution areas have substantially similar shapes and surface areas.

24. A method of fabricating a grinding tool, comprising:

providing a carrier substrate that has a working surface and a non-working surface respectively defined on two opposite sides;

affixing a plurality of first abrasive particles on the working surface, the first abrasive particles having a first average particle diameter;

affixing a plurality of second abrasive particles on the non-working surface, the second abrasive particles having a second average particle diameter that differs from the first average particle diameter, the carrier substrate with the first and second abrasive particles affixed thereon having a warped profile that protrudes on the side of the working surface; and pressing the carrier substrate having the warped profile against a support body so that the carrier substrate becomes substantially flat, and attaching the carrier substrate to the support body.

25. The method according to claim 24, wherein a ratio of the second average particle diameter to the first average particle diameter is between about 90% and 99.5%.

26. The method according to claim 24, wherein the first and second average particle diameters are respectively between about 50 μm and about 300 μm.

27. The method according to claim 24, wherein the first and second abrasive particles are respectively affixed to the working surface and the non-working surface via a first and a second bonding layer, the first bonding layer having a first thickness, and the second bonding layer having a second thickness smaller than the first thickness.

28. The method according to claim 27, wherein the second thickness is about 90% to 99.5% of the first thickness.

29. The method according to claim 24, wherein the carrier substrate is made of a metallic material.

30. The method according to claim 24, wherein the carrier substrate has a thickness between about 0.07 mm and about 2 mm.

31. The method according to claim 24, wherein the support body has a thickness between about 1 mm and about 20 mm.

32. The method according to claim 24, wherein the material of the first and second abrasive particles includes diamond, cubic boron nitride, aluminum oxide or silicon carbide.

33. The method according to claim 24, wherein the support body is made of stainless steel or epoxy.

34. The method according to claim 24, wherein the carrier substrate is affixed to the support body via an adhesion layer made of epoxy or polymethylmethacrylate (PMMA).

* * * * *